United States Patent [19]

Van Der Veer et al.

[11] Patent Number: 4,784,334

[45] Date of Patent: Nov. 15, 1988

[54] METHOD AND APPARATUS FOR BREAKING INTO PARTS OF A CERTAIN SIZE AND SCREENING A BULK MATERIAL

[75] Inventors: Paul Van Der Veer, Barendrecht; Ernest C. M. J. Schmitz, Cadier en Keer, both of Netherlands

[73] Assignee: P. Van Der Veer Holding B.V., Barendrecht, Netherlands

[21] Appl. No.: 183,439

[22] Filed: Apr. 13, 1988

Related U.S. Application Data

[63] Continuation of Ser. No. 932,735, filed as PCT NL86/00008 on Mar. 6, 1986, published as WO86/05125 on Sep. 12, 1986, abandoned.

[30] Foreign Application Priority Data

Mar. 7, 1985 [NL] Netherlands ..... 8500657

[51] Int. Cl.[4] ..... B02C 23/14

[52] U.S. Cl. ..... 241/14; 241/24; 241/29; 241/78; 241/81; 241/94; 241/152 A

[58] Field of Search ..... 241/DIG. 10, 14, 24, 241/29, 81, 94, 76, 77, 189 R, 186 R, 78, 175, 88.1, 88.4, 152 A

[56] References Cited

U.S. PATENT DOCUMENTS

| | | | |
|---|---|---|---|
| 1,239,188 | 2/1919 | Pfersch | 241/175 X |
| 2,383,045 | 8/1945 | DanBreejen et al. | 241/DIG. 10 X |
| 3,232,427 | 2/1966 | Wenta et al. | 241/94 X |
| 3,703,995 | 11/1972 | Sullivan et al. . | |
| 3,820,725 | 6/1974 | Bogie | 241/76 |
| 3,863,847 | 2/1975 | Day et al. | 241/DIG. 10 X |
| 3,897,910 | 8/1975 | Deve | 241/DIG. 10 X |
| 4,025,419 | 5/1977 | Musschoot . | |
| 4,074,867 | 2/1978 | Jacob | 241/DIG. 10 X |

FOREIGN PATENT DOCUMENTS

| | | |
|---|---|---|
| 672684 | 3/1939 | Fed. Rep. of Germany . |
| 800593 | 11/1950 | Fed. Rep. of Germany . |
| 1508725 | 3/1970 | Fed. Rep. of Germany . |
| 2350981 | 4/1975 | Fed. Rep. of Germany . |
| 2747235 | 4/1979 | Fed. Rep. of Germany . |
| 2749498 | 5/1979 | Fed. Rep. of Germany . |
| 1458004 | 11/1966 | France . |
| 2159373 | 6/1973 | France . |
| 1594359 | 7/1981 | United Kingdom . |

*Primary Examiner*—Mark Rosenbaum

*Attorney, Agent, or Firm*—Watson, Cole, Grindle & Watson

[57] ABSTRACT

A method and an apparatus for breaking into parts of a certain size and screening a bulk material, in which the bulk material is fed onto a flat grid (49) made to vibrate, the type and intensity of this vibration being chosen in a manner such that the large lumps of at least one type of material which do not pass directly through the openings in the grid are broken on the said grid, as a result of the said vibration movement, into fragments having a size which permits these fragments to pass through the openings in the grid. Preferably the material passing through the grid is collected on at least one screen (58, 59, 60) which is made to vibrate together with the grid and the material moving over this screen which has not fallen through is conveyed through a reduction device at the discharge of the screen, which device is formed by at least one breaker roller (64) having a double action and which can be made to rotate.

11 Claims, 6 Drawing Sheets

METHOD AND APPARATUS FOR BREAKING INTO PARTS OF A CERTAIN SIZE AND SCREENING A BULK MATERIAL

This application is a continuation of application Ser. No. 932,735, filed as PCT NL86/00008 on Mar. 6, 1986, published as WO86/05125 on Sept. 12, 1986; now abandoned.

The invention relates to a method for breaking a bulk material into parts of a certain size and screening the material.

BACKGROUND OF THE INVENTION

Up until now, in breaking and screening a bulk material, the material is first passed through a breaker of some type and then over a screen whereafter the oversize material remaining on the screen is passed again through a breaker and is screened if necessary.

This known method is relatively cumbersome and requires an extensive installation. Moreover, in such breaker installations, usually a considerable portion of the bulk material is broken to a unnecessarily too small of a size so that too much breaking energy is consumed than is strictly necessary.

SUMMARY OF THE INVENTION

The object of the invention is therefore to provide an improved method as mentioned herein above which does not present the disadvantages of the known method.

This object is achieved in the method according to the invention where the bulk material is fed onto a flat grid made to vibrate, the type and intensity of this vibration being selected in a such that at least a vibrating movement in the direction perpendicular to the plane of the grid is obtained with an intensity such that the large lumps of at least one type of material which do not pass directly through the openings in the grid are, as a result of said vibration movement, broken on said grid into fragments having a size which permits these fragments to pass through the openings in the grid.

Thus no more breaking energy is consumed than strictly necessary to break said large lumps of material into fragments of the desired size since as soon as a fragment is broken-off which is sufficiently small to pass through an opening in said grid, said fragment is withdrawn from the breaking action.

Preferably the bulk material is introduced substantially continuously at one edge of the grid and the type of vibration and the position of the grid with respect to the horizontal are selected such that the material is moved from the feed-end edge to the discharge edge of the grid with a speed with respect to the length of the grid such that the residence time of the said large material lumps on the grid is sufficiently long to make these lumps break down to the said size.

In this manner, the vibration of the grid is also used for a displacement of the material to be treated on the grid so that a continuous process is obtained.

Advantageously with a bulk material comprising at least two types of material with different breaking characteristics, the type and intensity of the vibration can be selected such that only large lumps of the more easily breaking type of material which do not fall directly through the openings in the grid are broken down to the said size so that the large lumps of the other type of material which do not fall directly through the openings remain behind on the grid or are discharged at the discharge edge thereof.

In addition, a separation of two types of material is obtained which is based on the specific breaking characteristics of these types of material so that these types of material may have the same specific weight. A separation of two types of material having the same specific weight has until now been a considerable problem which can only be solved with expensive, extensive and usually technologically complicated installations.

Preferably the material passing through the grid is collected on at least one screen which vibrates together with the grid and the material moving over this screen which has not passed through is conveyed through a reduction device at the discharge edge of the screen.

In this fashion, the vibration is used to subject the lumps of material falling through the grid to a further breaking action and to screen the material to the desired size, and also to pass the material remaining behind on the screen through a reduction device.

The invention also relates to a device for performing the method, the device consisting of a spring supported frame which is provided with means driven by a motor for vibrating the frame, a flat grid being mounted near the top and a discharge being mounted in the frame below the grid.

Preferably the openings in the grid are rectangular, and the longitudinal and transverse sides which delineate the openings running along parallel lines which cross each other with the longitudinal side running parallel to the direction of movement of the material over the grid, while elevations are disposed in such a manner on the tops, which are situated in one flat plane, of certain longitudinal or transverse sides which delineate the openings such that the elevations are stagered with respect to each other.

Between the grid and the discharge 13 mounted at least one screen deck, preferably preferably having a discharge end which merges into a breaker plate, and breaking means for operating with said breaker plate are provided which together with the breaker plate form a reduction device.

The breaking means advantageously be at least one breaking hammer with a plate-shaped head which is situated at a distance from an at least partially perforated breaker plate and a helve assembly joined to this head and projecting upwardly, which is mounted near its top end pivotally about a horizontal shaft so that by the pivotal movement of the breaking hammer, the head moves away from and towards the breaker plate, a stop being fitted on the helve assembly which bears against a cam member in a manner such that said hammer can swing upwards only in one direction from the breaker plate and the return swinging movement is limited by the cam member.

In operation, the screen deck is also made to vibrate, the lumps of material which do not fall through the screen being advanced between the plate-shaped breaking hammer and the breaker plate so that the breaking hammer is pivoted upwardly and then falls down on the lumps of material and thus breaks them to fragments which are permitted to fall through the perforations of the breaker plate.

Preferably the stop on the helve assembly and the cam member are formed such that as a result of a displacement of these components with respect to each other, the distance between the plate-shaped head of the breaking hammer and the breaker plate can be adjusted.

Advantageously the horizontal shaft is mounted on a fixed support and the cam member is mounted in the frame, such that the distance between the head of the breaking hammer and the breaker plate adjusts itself to a constant value when an increase of the weight of the material on the screen deck by said frame sinking deeper into the resilient support whereas otherwise the distance between the breaker plate and the head of the hammer would change.

Advantageously the breaking means may also be formed by at least one breaker roller with a horizontally extending shaft which can be made to rotate, for example by said motor through the vibrator shaft or by a separate motor. Preferably the screen deck consists of at least two separate parts, the first part merging at the discharge end thereof into a lower breaker plate which is disposed below the breaker roller, the discharge end of the second part ending at the top of the breaker roller, and the breaker plate belonging to this part being disposed above the breaker roller, whereas above the lower breaker plate there is disposed, immediate adjacent to the breaker roller, a collecting member extending transversely through the frame, which member is joined at the sides of the breaker roller to discharge channels extending downwards passed the lower breaker plate, and above the top breaker plate and said collecting member there is disposed a deflector-plate.

In this manner, a double functioning with a double breaking capacity is obtained in that the material to be reduced in size is transported to both sides of the breaker roller by the screen deck parts which vibrate together with the frame.

Preferably the deflector plate extends obliquely from top to bottom towards one of the two parts of the screen deck, the section of this plate located above the collecting member being formed as a screen plate so that material falling on the section of the deflector plate formed as a screen plate can be sieved directly and said screen plate portion is less therefore loaded.

BRIEF DESCRIPTION OF THE DRAWINGS

The invention will be explained in more detail by referring to the drawing in which.

DETAILED DESCRIPTION OF THE PREFERRED EMBODIMENTS

Figure 1:
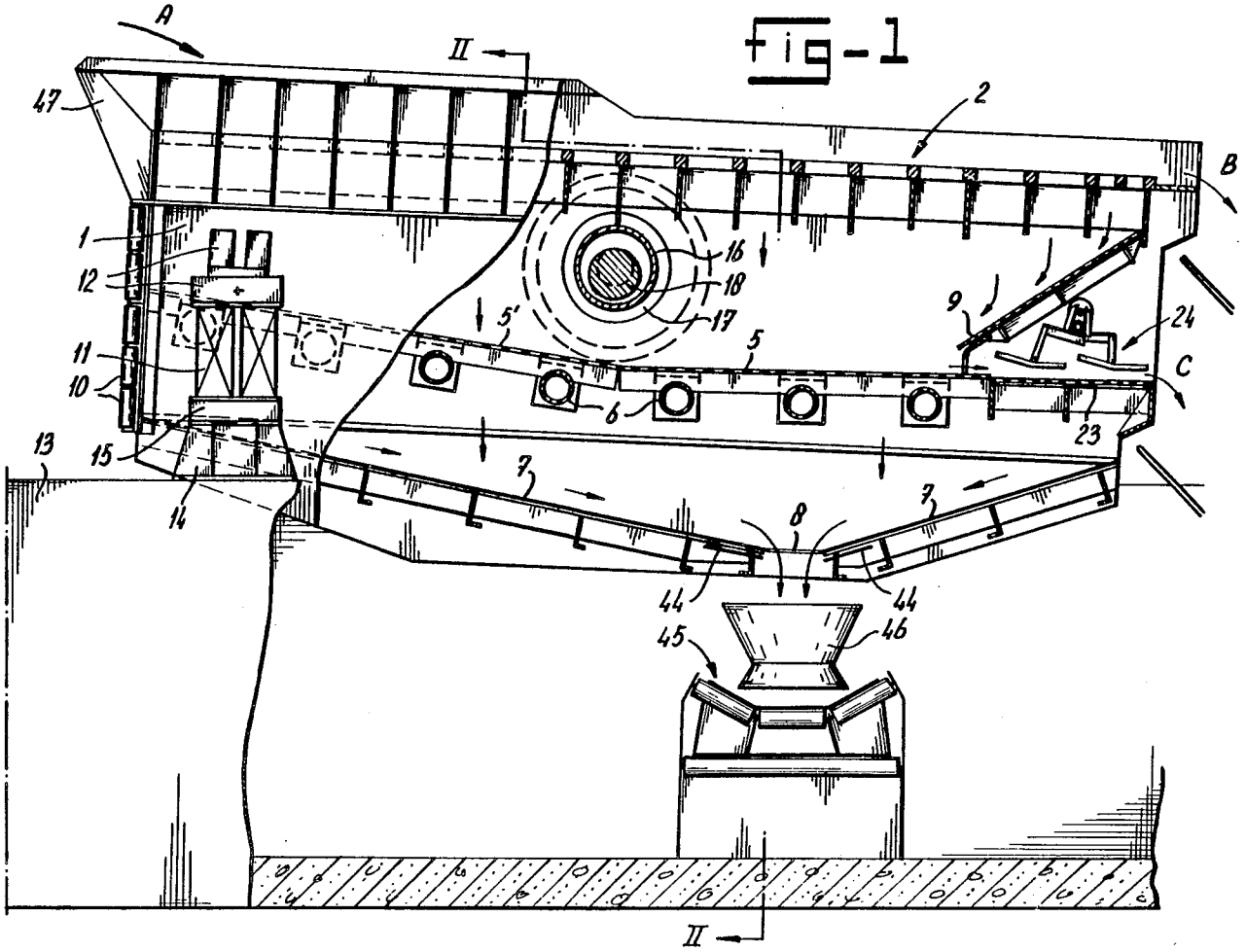
FIG. 1 shows an embodiment of a device according to the invention in longitudinal section and partially in side view.
Figure 2:
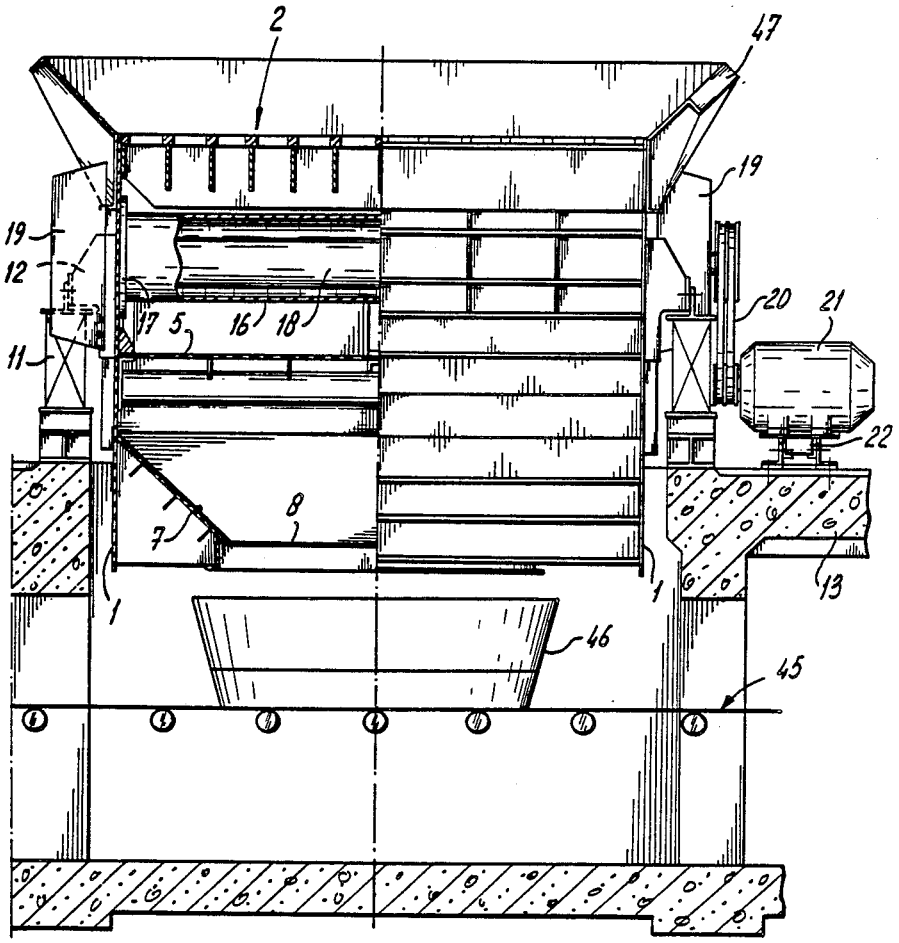
FIG. 2 shows in the left-hand part a transverse section along the line II—II in FIG. 1 and in the right-hand part an end view of the device according to FIG. 1.

As shown in FIGS. 1 and 2, the device according to the invention comprises a frame formed from heavy steel side plates 1. Between these side plates 1 near the top there is mounted a grid 2 and below this grid a sieve plate 5 and 5' which is supported by transversely running hollow rods 6, the sieve plate portion 5 being positioned in a less sloping manner than the sieve plate portion 5'. Between the lower portion of side plates 1 there is mounted a somewhat funnel-shaped bottom 7 with a discharge opening 8. Below the grid 2 there is additionally disposed a baffle 9 between the side plates 1. Inspection covers 10 on the one hand provide for a dust tight and a sound-damping seal and on the other hand provide access to the interior of the device for maintenance, repair and replacement activities.

The frame including side plates 1 is spring supported at the corners by four spring assemblies 11 which are each situated between a support 12 attached to a side plate 1 and a bracket 14 disposed on a base 13 with a filler plate 15 inserted in between.

A vibrator shaft housing 16 disposed between the side plates 1 is attached by means of the flanges 17 to the respective side plates 1. Through this shaft housing 16 there extends a vibration generator with an eccentric shaft 18 which carries adjustable counterweights (not shown) at both ends which are covered by the protective caps 19. The vibrator shaft 18 is driven via V belt 20 by a motor 21 mounted on the base or foundation 13, this motor being situated on a rotatable motor bracket 22.

Instead of the one single-shaft vibrator shown, several vibrators, possibly with more shafts or vibrators of other types, can be used according to specific requirements of the device. Other forms of drives for the vibrator(s) are also possible such as, for example, by means of a universal joint, with or without a V-belt transmission inserted in between.

Figure 4:
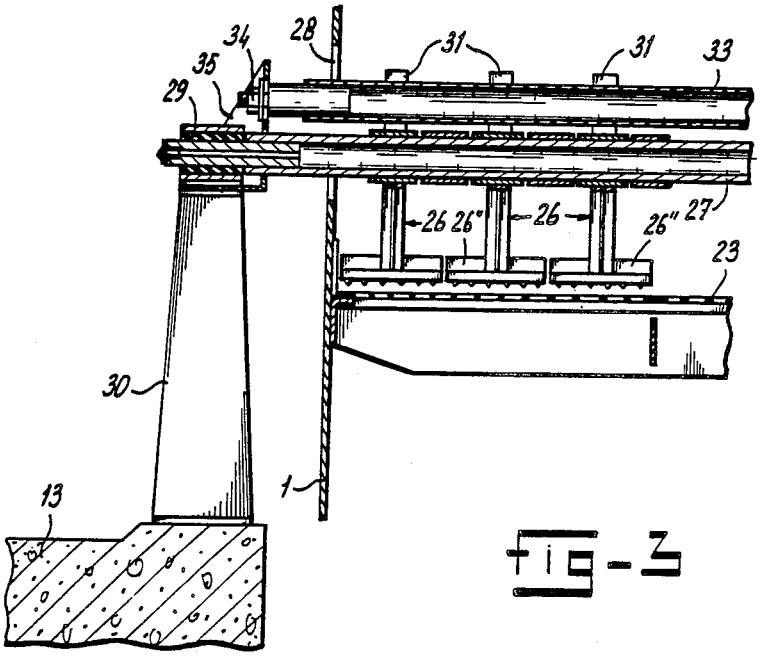
FIG. 4 shows a section along the line IV—IV in FIG. 3.
Figure 3:
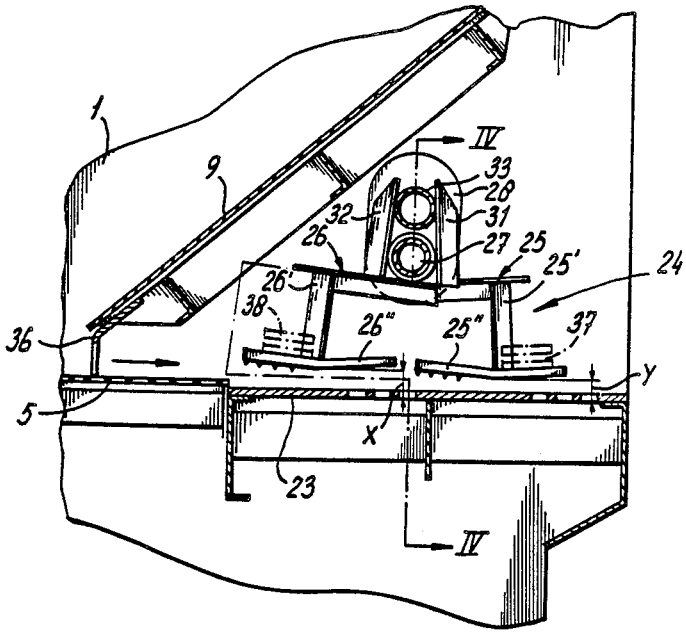
FIG. 3 depicts the breaking device on the right in FIG. 1 on a larger scale.

The sieve plate 5 merges, at the discharge end thereof, into a partially perforated breaker plate 23 which is secured between the side walls 1 and cooperates with the breaking hammer assemblies 24. As shown in FIGS. 3 and 4, two rows of breaking hammers 25 and 26 are provided each of which have a plate-shaped head 25", 26" and a helve assembly 25' and 26' by means of which the breaking hammers 25 and 26 are disposed rotatably on a shaft 27. The shaft 27 extends transversely through the device and projects through openings 28 in side plates 1 so that the ends of the shaft 27 are supported by means of rubber torsion blocks 29 by the arms 30 mounted on the foundation 13. The hammers 25 and 26 can be lubricated by the hollow shaft 27. On the helve assemblies 25' and 26', there are secured stops 32 and 31 respectively, which, on either side, lie against a shaft 33 which acts as a cam so that the hammers 25 and 26 can swing up only in one direction from the breaker plate 23. The shaft 33 is secured at the extremities by means of nuts 34 adjacent brackets 35 attached to the arms 30. The cam shaft 33 can be secured in various positions by means of the nut 34, as a result of which the breaker openings x and y can be adjusted. From FIG. 3 it is clear that if the cam shaft 33 is shifted upwardly, both the breaker openings x and y will become somewhat larger, and if the shaft 33 is shifted downwards, they will become somewhat smaller. A shift of the cam shaft 33 to the left in FIG. 3 will cause the breaker opening y to become somewhat larger and the breaker opening x somewhat smaller, while if the shaft 33 is shifted in the other direction, the opening x will become somewhat larger and the opening y somewhat smaller. At the bottom edge of the baffle 9 there is disposed a finger plate 36 which holds back foreign objects such as pieces of reinforcing steel, wood, wire, etc., contained in the loose material so that these foreign objects can be periodically removed.

The shafts 27 and 33 may also be supported by a supporting structure located behind the device so that they do not project through openings in the side plates 1. It can be also possible that the cam shaft 33 is supported by the device itself, and as a result an advantage is achieved in that the openings x and y become self-adjusting, i.e., if the device sinks deeper in the spring support 11 during a heavy loading, the breaker plate 23 will move from the hammer heads 25",26" and the openings x and y would become greater, these openings x and y remain constant as a result of the cam shaft 33 then also shifting downwards. Finally, it is also additionally possible for the breaking hammer assembly 24 to be wholly supported by the device itself, in which case, with use being made of rubber torsion blocks, the secondary (harmonic) vibrations of the hammers which occur can be used to bring about a breaking action.

The hammers 25 and 26 can be made heavier by means of additional weights 37 and 38 in order to supply the proper breaking force.

Figure 5:
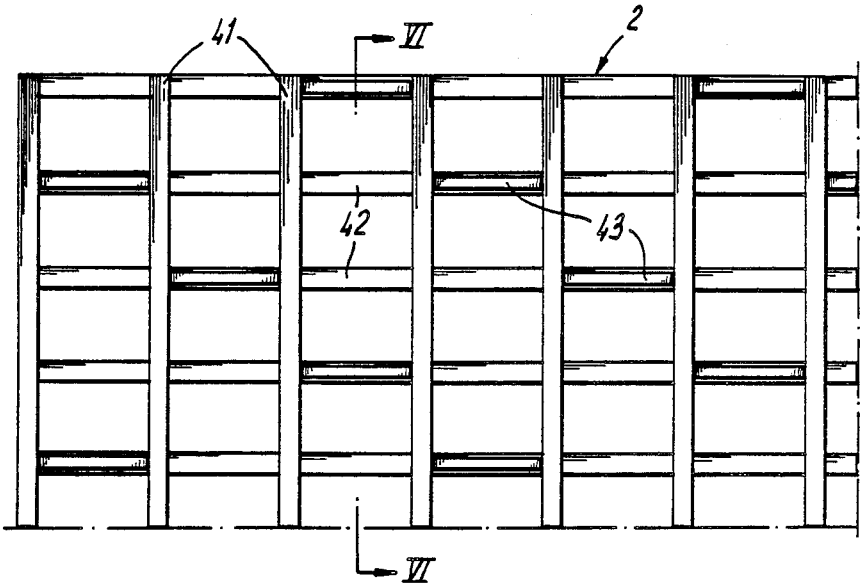
FIG. 5 depicts a part of the grid of the device according to FIG. 1 in plan view.
Figure 6:
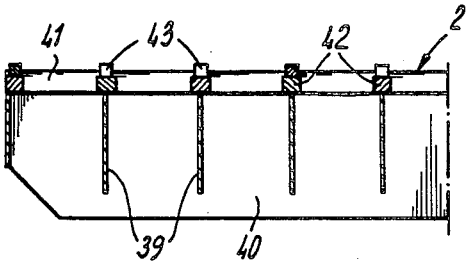
FIG. 6 is a section along the line VI—VI in FIG. 5.

As shown in FIGS. 5 and 6, the grid 2 is formed by a set of longitudinal spars 39 and cross spars 40 with solid steel cross beams 41 being disposed on top of the cross spars and the filler pieces 42 being disposed on the longitudinal spars. In addition, on certain filler pieces 42 there are welded additional pieces of steel such that a staggered pattern of projecting elements 43 is obtained. Instead of the form shown, the additional pieces of steel forming projecting elements 43 may be shorter, sharper and narrower, or tooth- or point-shaped. It is also possible to position projecting members of this type also on, or possibly exclusively on, the cross beams 41.

Referring back to FIG. 1 sliding plates 44 which allow the size of the discharge opening 8 to be altered. Below the discharge opening 8 is a conveyor belt 45 with a funnel-shaped distributing member 46 to direct removal of the material flowing out of the device. On top of the device is a hopper or chute 47 which vibrates at the same time, but such a chute can be also be stationary above the device.

When the device is in operation, it is caused to vibrate by the vibrator 18 rotate by the motor 21. The bulk material is then dumped on the grid 2 in the direction of A, large fragments which do not immediately fall through the openings in the grid 2 being broken up by the shaking effect of the grid 2 vibrating up and down into fragments which are able to fall through the openings in the grid. If the bulk material consists of two types of material with different breaking characteristics, then the large lumps of the less easily breakable material which are not broken on the grid 2 but are removed from the device in the direction of arrow B. The material falling through the grid 2 lands on the sieve plates 5 and 5' which is also vibrating. As a result, this material is subjected to a further breaking action and is at the same time is sieved to the desired dimensions, the sieved material falling onto the bottom structure 7 and is then discharged through the outlet 8 onto the conveyor belt 45 and the material is removed. The larger lumps remaining on the sieve plates 5 and 5' are gradually conveyed towards the breaking hammers 24 where this material is crushed against the breaker plate 23 and falls through the perforations in the breaker plate into the bottom structure 7. Lumps which have not been broken are discharged at in the direction of arrow C.

Figure 7:
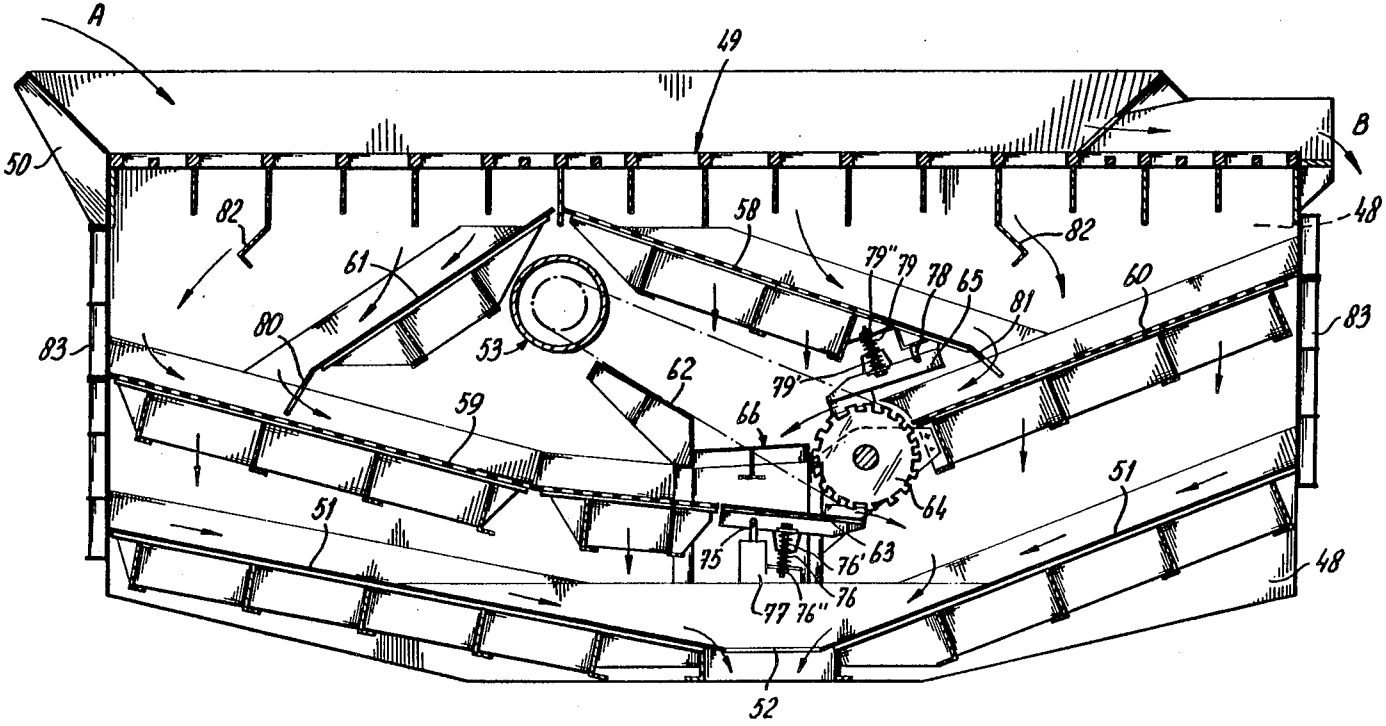
FIG. 7 shows a second embodiment of the device according to the invention in longitudinal section.
Figure 8:
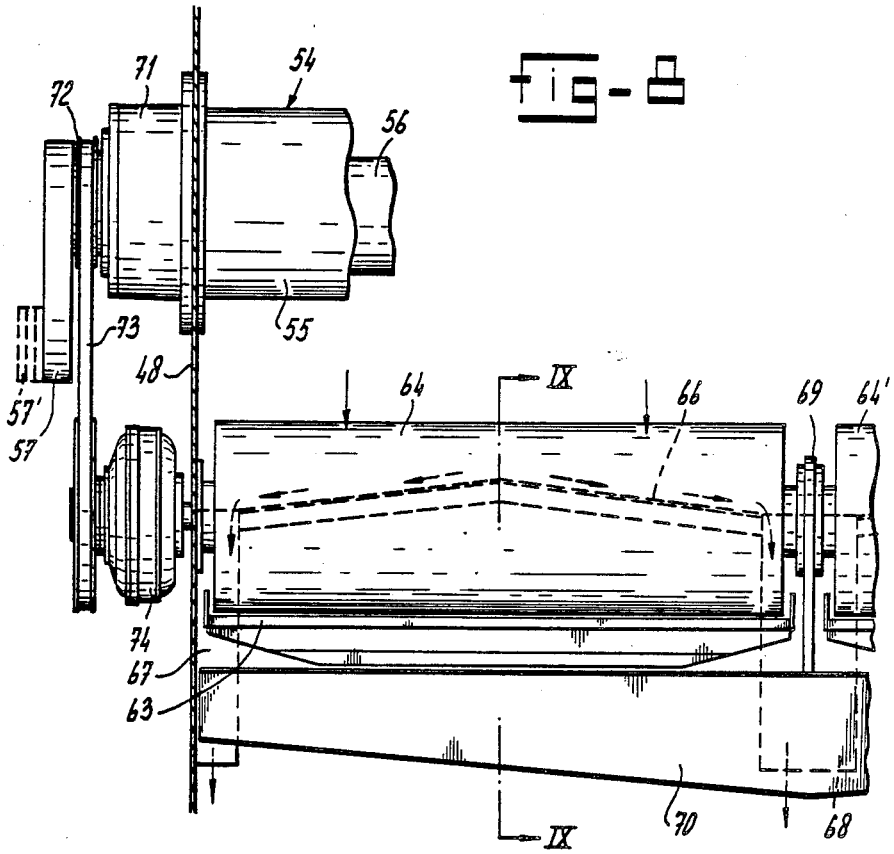
FIG. 8 shows the breaking roller in the device according to FIG. 7 in front view on a larger scale.
Figure 9:
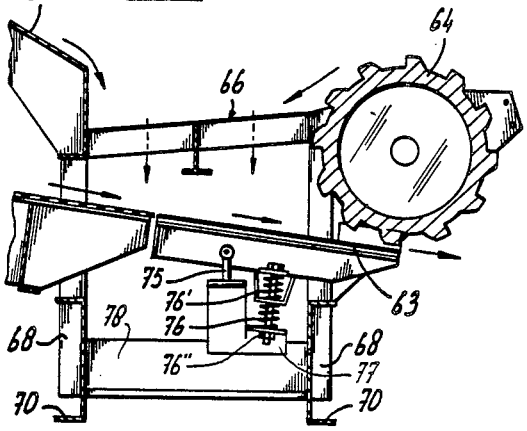
FIG. 9 is a section along the line IX—IX in FIG. 8.

The embodiment of the device according to the invention shown in FIGS. 7, 8 and 9 also comprises a frame consisting of two side plates 48, between which at the top is disposed a grid 49 which may be constructed in the same manner as the grid shown in FIGS. 5 and 6. About the grid there is also a hopper or chute structure 50. At the bottom mounted between the side plates 48 is a bottom structure 51 with a discharge 52, which opening may also be adjustable by slides 44 as shown in FIG. 1. The device can again be caused to vibrate by the vibrator 53 which is driven by a motor (not shown). The vibrator 53 again comprises a vibrator shaft housing 55 mounted between the side plates 48 with an eccentric or concentric shaft 56 running through the said housing, which shaft is provided at both ends with adjustable counterweights 57 as is shown in FIG. 8.

Between the grid 49 and the bottom structure 51 are mounted three sieve plates 58, 59 and 60, and two baffles 61 and 62 between the side plates 48. The sieve plate 59 merges, at the discharge end thereof, into a breaker plate 63 which can act together with a breaker roller assembly 64 at the bottom thereof. At the discharge end of the sieve plate 60 is a top breaker plate 65 which also acts together with the breaker roller assembly 64, but at the top thereof, so that the breaker roller assembly 64 has a double action and a double breaker capacity. The material comminuted between the breaker roller assembly 64 and the bottom breaker plate 63 falls directly onto the bottom structure 51 to be discharged through the discharge opening 52. The material comminuted between the top breaker plate 65 and the breaker roller assembly 64 is collected by a collection member 66 consisting of a roof-shaped plate which is in contact at the sides with the vertical discharge channels 67 and 68 which debouch above the bottom structure 51 as is shown in FIG. 8.

As is shown in further detail in FIGS. 8 and 9, the breaker roller assembly 64 comprises two breaker rollers 64 and 64' which are each mounted between a center plate 69 and a side wall 48. The center plate 69 is mounted on cross beams 70 which also support the collection member 66, 67 and 68. For a relatively narrow device, however, one breaker roller may be sufficient. The breaker rollers 64 and 64' are each driven by the vibrator shaft 56 via a pulley 72, disposed between bearing housing 71 and the counterweight 57 with add-on plates 57' optionally making this counterweight heavier, and a V-belt 73 passed thereover. For safety and drive-engineering reasons, rollers 64 and 64' are driven through a hydraulic clutch 74 with a thermal cutout of other type of clutch which provides protection against jamming and overloading, preferably the clutch being combined with a warning device.

It is shown in FIG. 9, the breaker plates 63 are supported by torsion bearing 75 and springs 76 and 76' by the seats 77 which are positioned between the cross arms 78. By tightening the clamping bolt 76" to a greater or less extent, the minimum distance between the circumference of the breaker roller and the breaker plate can be adjusted or readjusted. The top breaker plate is spring supported in the same manner by the torsion bearings 78 and the springs 79 and 79'.

Finger plates 80 and 81 are shown in FIG. 7 at the discharge end of the baffle 61 as are sieve plate 58 respectively, as are guides 82 on the bottom of the grid 49. The device is provided at both ends with inspection covers 83.

When the device is in operation, the bulk material is again introduced in the direction of arrow A onto the grid 49 which is caused to vibrate. A as a result, the large lumps which do not fall directly through the openings in the grid are broken on the grid and lumps of a material which break less rapidly which may not have broken are discharged in the direction of arrow B. Some of the material falling through the grid 49 falls to the left in FIG. 7 directly onto the sieve plate 59 and some falls first onto the baffle flows 61 and from this baffle onto the sieve plate 59. The material falling through the sieve plate 59 is collected on the bottom structure 51 to be discharged through the discharge opening 52. The material remaining behind on the sieve plate 59 is gradually conveyed to the breaker plate(s) and is comminuted between one or more of these plates and the breaker roller(s) in order subsequently to fall onto the bottom structure 51 and to be removed through the discharge opening 52. Some of the material falling through the grid 49 on the right in FIG. 7 lands on the sieve plate 58 and some lands on the sieve plate 60. Some of the material falling through the sieve plate 58 is collected by the guide plate 62 and conveyed from there to the collection member 66 and partially falls directly onto the collection member 66, whereafter this material is conveyed through the vertical side channels 67 and 68 to the bottom structure 51 in order to be removed through the discharge opening 52. The material remaining behind on the sieve plate 58 is conveyed onto the sieve plate 60 and from there, together with the material remaining behind on the said sieve plate 60, is conveyed to the breaker roller 64 and the breaker plate 65 in order to be comminuted, whereafter this comminuted material is discharged through the collection member 66 and the vertical channels 67 and 68. The material falling through the sieve plate 60 lands directly on the bottom structure 51. The finger plates 80 and 81 ensure that larger foreign objects cannot pass between the breaker roller(s) 64 and the breaker plates 63 and 65.

We claim:

1. A method for breaking lumps of a loose bulk material into fractions of a certain size and screening the material, the method comprising feeding the lumps of loose bulk material onto one end of a flat grid, vibrating said flat grid such that at least a vibration movement in the direction perpendicular to the plane of the grid is obtained with an intensity such that large lumps of at least one type of bulk material which do not pass directly through the openings in the grid are, as a result of the said vibration movement, broken on said grid into fragments having a size which allows these fragments to pass through the openings in the grid, removing the lumps of bulk material which have not passed through said grid from a second end thereof as a first fraction, collecting the fragments of bulk material passing through said grid on a screen located below said grid and which vibrates with said grid, some of said fragments of bulk material passing through said screen and some of said fragments remaining on said screen, conveying said fragments of bulk material remaining on said screen through a mechanically driven reduction device at a discharge end of said screen to reduce their sizes, collecting the fragments of bulk material passing through said screen and the fragments of bulk material obtained from said mechanically driven reduction device on a common bottom structure, and discharging said collected fragments through a discharge opening in said bottom structure as a second fraction.

2. A method according to claim 1, wherein the loose bulk material is introduced essentially continuously at one edge of the grid and the type of vibration and the position of the grid with respect to the horizontal is selected such that the material is moved from a feed end edge to a discharge edge of the grid with a speed with respect to the length of the grid such that the residence time of the said large material lumps on the grid is sufficiently long to make these lumps break down to the said size.

3. A method according to claim 1, wherein the loose bulk material comprises at least two types of material with different breaking characteristics, and the type and intensity of the vibration is selected such that only large lumps of the more easily breaking type of material which do not fall directly through openings in the grid are broken down to said size so that the large lumps of the other type of material which do not fall directly through the openings remain on the grid or are discharged at a discharge edge thereof.

4. A device for reducing the sizes of lumps of loose bulk material and for separating the lumps into fractions of different sized lumps, said device including a frame, a spring means for movably supporting said frame, a flat grid mounted in said frame, said flat grid having a first end onto which lumps of loose bulk material are deposited and an opposite second end from which a first fraction of lumps of loose bulk material which have not passed through said flat grid are discharged from said device, a sieve plate mounted in said frame below said flat grid and onto which the lumps of loose bulk material which have passed through said flat grid fall, said sieve plate having a discharge end, a breaker plate mounted in said frame at the discharge end of said sieve plate and onto which lumps of loose bulk material which have not passed through said sieve plate move, breaking means mounted in said frame and cooperable with said breaker plate to reduce the sizes of the lumps of bulk material therebetween, a bottom structure mounted in said frame below said sieve plate and onto which the lumps of loose bulk material which pass through said sieve plate fall, said bottom structure defining a discharge outlet for a second fraction of lumps of loose bulk material, and drive means for vibrating said frame in at least a direction perpendicular to said flat grid so that the lumps of bulk material thereon will impact against the grid and be reduced in size.

5. A device according to claim 4, wherein said flat grid is composed of longitudinal spars and cross spars which together define rectangular openings therebetween, and wherein said longitudinal spars include upwardly-projecting elements between said cross spars.

6. A device according to claim 4, wherein said breaker plate is perforated and wherein said breaking means are formed by at least one breaking hammer with a plate-shaped head which is situated at a distance from said perforated breaker plate, and a helve assembly, joined to the plate-shaped head projecting upwardly, which is mounted near its top end pivotally about a horizontal shaft so that by the pivotal movement of the breaking hammer, the head moves away from and towards the breaker plate, a stop being fitted on the helve assembly which bears against a cam member in a manner such that the breaking hammer can swing upwardly only in one direction from the breaker plate and return swinging movement is limited by the cam member.

7. A device according to claim 6, wherein the stop on the helve assembly and the cam member are mounted such that, as a result of a displacement of said helve assembly and said cam member with respect to each other, the distance between the plate-shaped head of the hammer and the breaker plate can be adjusted.

8. A device according to claim 6, wherein said horizontal shaft is mounted on a fixed support and the cam member is mounted in the frame.

9. A device according to claim 4, wherein the breaking means include at least one breaker roller with a horizontally extending shaft which can be made to rotate by said motor.

10. A device according to claim 9, wherein said sieve plate comprises at least two separate parts, the first part merging at the discharge end thereof into a lower breaker plate which is disposed below the breaker roller, the discharge end of the second part ending at the top near the breaker roller, and the breaker plate belonging to this part being disposed above the breaker roller, while above the lower breaker plate there is disposed, immediate adjacent to the breaker roller, a collection member extending transversely through the frame, which member is joined at the sides of the breaker roller to discharge channels extending downwardly passed the lower breaker plate, and above the top breaker plate and the said collection member is a deflector plate.

11. A device according to claim 10, wherein the deflector plate extends obliquely from top to bottom towards one of the two parts of the screen plate, the portion of this plate located above the collection member being constructed as a screen plate.

* * * * *